United States Patent [19]

Howe

[11] Patent Number: 4,998,430

[45] Date of Patent: Mar. 12, 1991

[54] MANUFACTURE OF ROTOR LAMINATION FOR A DYNAMOELECTRIC MACHINE

[75] Inventor: Conrad L. Howe, Paragould, Ark.

[73] Assignee: Emerson Electric Co., St. Louis, Mo.

[21] Appl. No.: 534,333

[22] Filed: Jun. 7, 1990

Related U.S. Application Data

[62] Division of Ser. No. 402,558, Sep. 5, 1989, abandoned.

[51] Int. Cl.[5] ..... B21D 28/00

[52] U.S. Cl. ..... 72/335; 72/329; 72/330; 72/336; 83/40; 83/86; 83/103; 83/167; 83/405; 83/695

[58] Field of Search ..... 83/25, 40, 41, 49, 50, 83/86, 103, 167, 405, 695, 620; 72/335, 336, 329, 330, 331, 464, 404

[56] References Cited

U.S. PATENT DOCUMENTS

| | | | |
|---|---|---|---|
| 2,308,277 | 1/1943 | Gillen | 83/50 |
| 2,350,004 | 5/1944 | Whistler et al. | 72/331 X |
| 2,436,108 | 2/1948 | Heftler | 83/620 X |
| 2,690,802 | 10/1954 | Russell | 83/40 X |
| 3,107,566 | 10/1963 | Archer | 83/40 X |
| 3,383,065 | 5/1968 | Bergeron et al. | 83/143 X |
| 3,460,415 | 8/1969 | Philipp | 83/41 X |
| 3,465,634 | 9/1969 | Blais | 83/695 |
| 3,580,122 | 5/1971 | Powell | 83/108 |
| 3,650,167 | 3/1972 | Hoffmeyer et al. | 83/49 X |
| 3,788,118 | 1/1974 | Joseph | 72/324 |
| 4,787,282 | 11/1988 | Okachi et al. | 83/25 |

*Primary Examiner*—Hien H. Phan
*Assistant Examiner*—Eugenia A. Jones
*Attorney, Agent, or Firm*—Polster, Polster and Lucchesi

[57] ABSTRACT

In a progressive die for punch press operations in which a strip of material is fed into the press and sequential operations are conducted on the strip including the separation of parts from the strip. The die is provided with a construction which forms an integral carrier tab between the parts to be separated. In the embodiment ilustrated, the operation is the manufacture of rotor and stator laminations for a dynamoelectric machine. The strip of material is fed into the press in which the die is mounted, and the respective rotor and stator laminations are formed in a series of workstations within the die. The improvement in the die construction is a punch station for substantially but not completely separating the rotor lamination from the strip. Thereafter, additional operations are constructed on the strip, the rotor lamination being completely separated at a subsequent workstation. The integral carrier tab for the rotor lamination prevents the forming of burrs of material around the perimeter of the rotor or that portion of the strip from which the lamination is separated.

2 Claims, 4 Drawing Sheets

MANUFACTURE OF ROTOR LAMINATION FOR A DYNAMOELECTRIC MACHINE

This is a divisional application of copending application Ser. No. 07/402,558, filed on Sept. 5, 1989, now abandoned.

BACKGROUND OF THE INVENTION

This invention relates to punch press operations and the construction of progressive dies used in those operations. While the invention is described with particular reference to the manufacture of stator and rotor laminations for dynamoelectric machines in the form of induction motors, those skilled in the art will recognize the wider applicability of the inventive principles disclosed hereinafter.

As is well known in the electrical arts, dynamoelectric machines such as electric motors include rotor and stator assemblies which are constructed from stacks of individual laminations. The laminations are formed by a multi-station progressive die mounted in a punch press. A strip of metal stock is fed into one end of the press. The strip is carried through successive work stations in the die where, first rotor laminations and then stator laminations are formed. With respect to rotor laminations, a blanking punch in the die previously has been used to completely punch out the rotor lamination blank at one of the intermediate work stations. Conventionally, the punched out blank then was returned into the opening from which it was punched so that additional operations could be conducted on the strip. The rotor lamination was finally separated from the strip at another station.

Problems are sometimes encountered because of the manufacturing process just described. For example, a continuing problem in motor manufacturing occurs in the press operation when the blanking punch punches out the rotor lamination which is then pushed back into the opening just formed. If there are variations in the thickness of the material, or a difference in hardness, or if the temperature range of the press causes variations in the expansions of the material, or if over time die tolerances change, the punched out rotor lamination often is not properly pushed back into its former position. As a result, burrs of material are formed around at least a portion of the strip or the rotor lamination when the rotor lamination blank is pushed back into place. This edge material can cause problems in die operation in the succeeding steps of lamination manufacture in that substantial increases in thicknesses of material being processed are encountered. A further problem is encountered in conventional dies used to manufacture interlocked rotors, where the rotor lamination is punched out and then returned to the strip. Because of the likelihood of burr formation on the rotor lamination, "spongy" rotor stacks often result from the manufacturing process. The situations described can be such as to cause substantial down time of the press while corrective measures are taken. Downtime of course, increases the cost of the manufacturing process.

One of the objects of this invention is to provide an improved die construction for manufacturing a part from a strip of material.

Another object of this invention is to provide an improved method and structure for constructing rotor and stator laminations for use in dynamoelectric machines in the form of electric motors.

Another object of this invention is to provide an integral carrier tab for parts intended to be separated in punch press operation.

Another object of this invention is to provide a blanking punch in a compound die in which at least one groove is formed therein whereby the blanking station substantially but does not completely punch out one part from the other at the station where the punch is used.

Another object of this invention is to provide a die which forms an integral carrier tab for parts to be separated in the die.

Another object of this invention is to provide a die construction which improves manufacturing operations and lowers cost.

Yet another object of this invention is to keep control of a stamped part from one station to succeeding stations in the die, thereby eliminating burrs or small strips of metal in the outer diameter (O.D.) of the blank that causes spongy stacks in the interlocked cores.

Other objects of this invention will be apparent to those skilled in the art in view of the following description and accompanying drawings.

SUMMARY OF THE INVENTION

In accordance with this invention, generally stated, a progressive die for a punch press has a plurality of stations at which predetermined configurations are stamped in a strip of material fed into the press. In the preferred embodiment, the die forms rotor and stator laminations for a dynamoelectric machine. Commonly, the rotor lamination configuration is formed first, and the rotor lamination is separated from the strip. The die of the present invention includes a punch station which forms an integral carrier tab during the punching operation so that the rotor lamination is substantially but not completely separated from the strip at a first station. The carrier tab enables the strip to carry the rotor lamination to at least one succeeding station, where the rotor lamination is finally removed from the strip.

BRIEF DESCRIPTION OF THE DRAWINGS

In the drawings.

Corresponding reference characters indicate corresponding parts throughout the several views of the drawings.

DESCRIPTION OF THE PREFERRED EMBODIMENT

Figure 1:
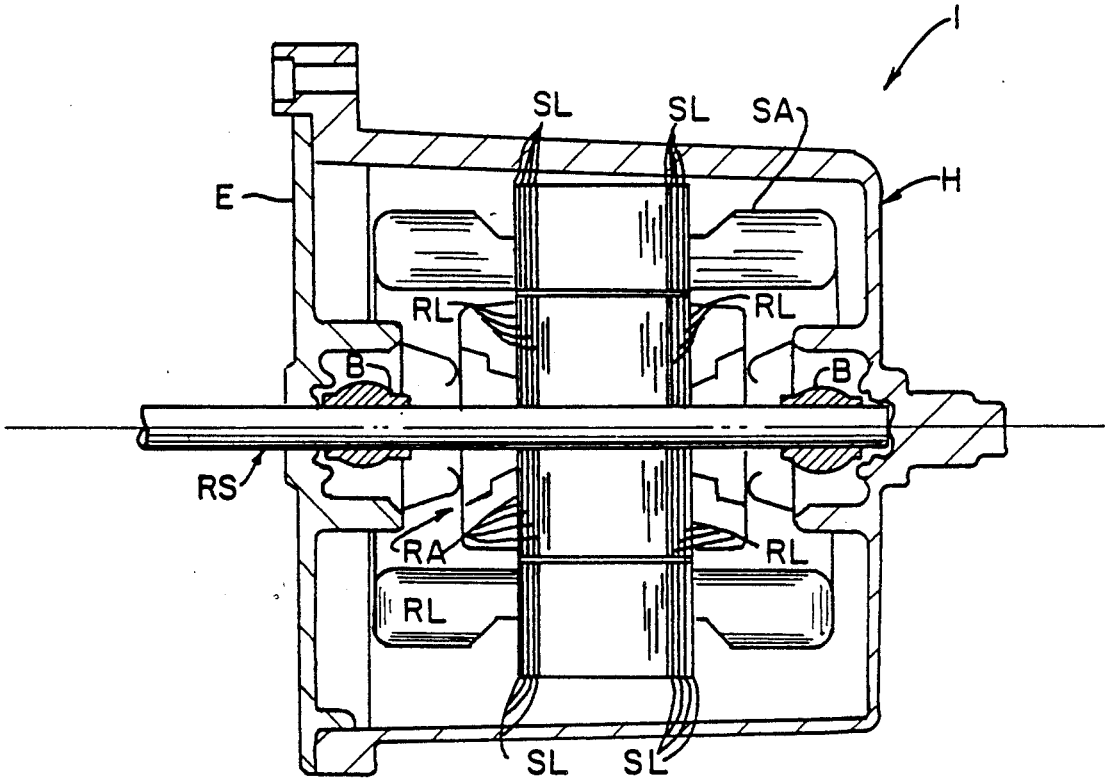
FIG. 1 is a cross-sectional view of one illustrative embodiment of a dynamoelectric machine in the form an electric motor illustrating a rotor assembly and a stator assembly for the machine.
Figure 2:
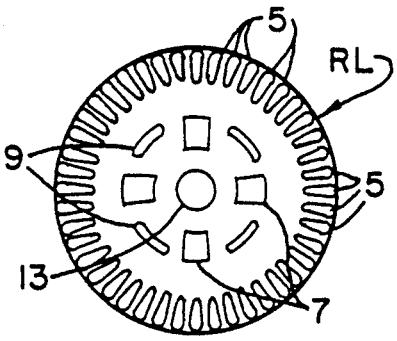
FIGS. 2 and 3 respectively represent a rotor lamination and a stator lamination from which the rotor and stator assemblies are formed.
Figure 3:
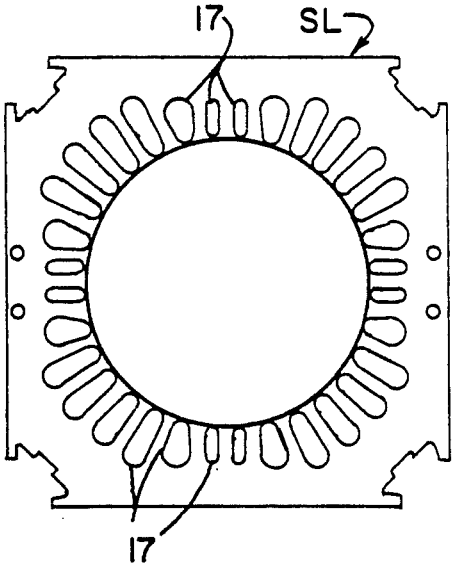

Referring now to the drawings, a dynamoelectric machine is indicated generally by the reference numeral 1 in FIG. 1. The dynamoelectric machine, which is the embodiment illustrated is an electric motor, includes a housing H. A stator assembly SA, a rotor assembly RA, and a rotor shaft RS are mounted in the housing H in a conventional manner. The rotor shaft (RS) is journalled in bearings B. The shaft RS has one end extending through an end shield E of the motor. As is well known in the art, electrical energy supplied to the motor produces a mechanical output. The motor is connected to a using system or appliance (not shown) for the rotary motion of the shaft to be translated into useful work. The motor 1 itself is conventional and forms no part of the present invention. While a particular construction has been shown and described, those skilled in the art will recognize that a variety of constructions well known in the art are compatible with the wider aspects of the present invention.

As shown in FIG. 1, both the stator and rotor assemblies are constructed for a plurality of individual laminations, denominated as stator laminations SL, and rotor laminations RL. The respective laminations are formed during a punch press operation, as will be described hereinafter. The laminations so produced are formed together into stacks. The individual laminations themselves are configured to accept other components of the motor, and include slots for accepting the motor windings, for example. The laminations are joined to one another by any convenient method. Welding, cleating, or adhesive bonding, alone or in combination, are usual methods in the field.

Figure 8:
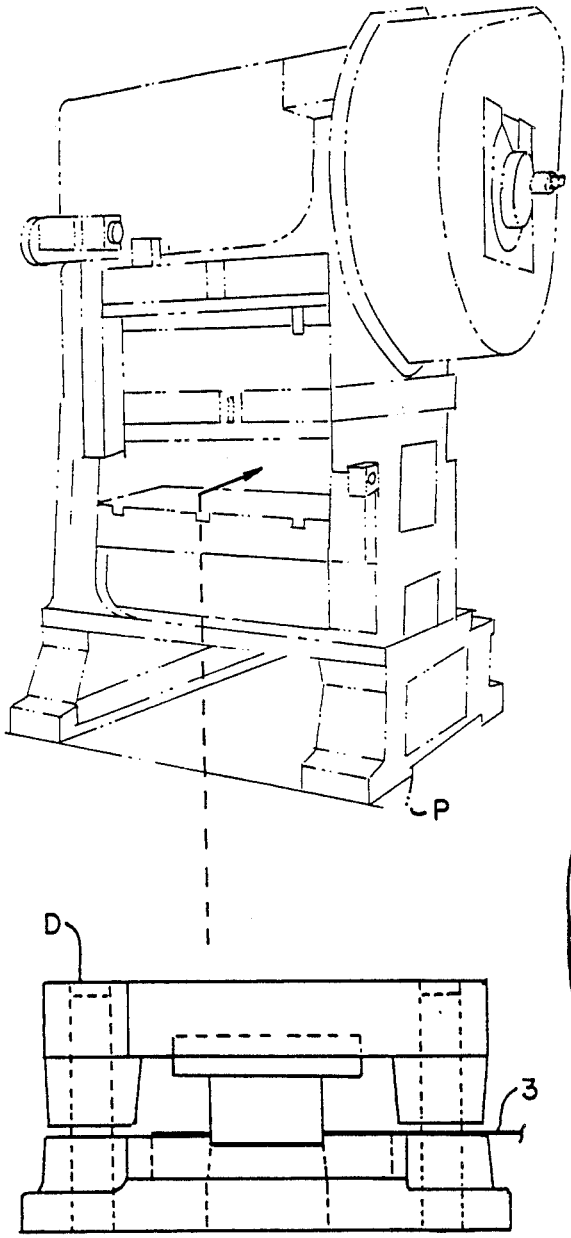

As shown in FIG. 8, a strip 3 of metal material is fed into a punch press P. The press includes a progressive die D incorporating a series of work stations through which the material is progressively or successively fed to manufacture the rotor laminations RL and stator laminations SL. The operation of die D is described with respect to FIGS. 4A, 4B and 4C. These FIGURES illustrate the operations performed on the material strip 3 at successive work stations of the die. As is well known in the art, each cycle of the press causes an operation to be performed at each of the work stations to be described. Movement of the strip through the die is indicated by the direction arrows.

Figure 4A:
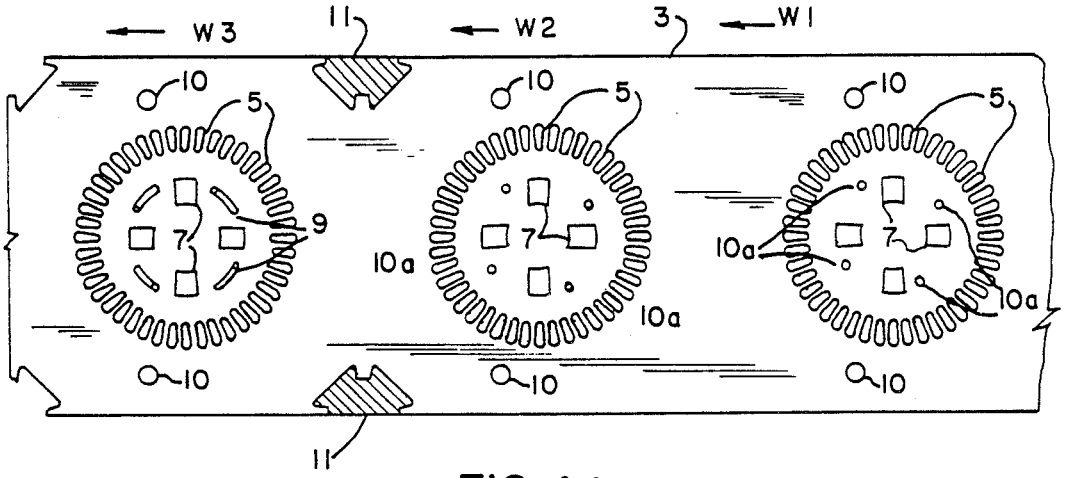
FIGS. 4A, 4B, and 4C are top plan views of a strip of material fed into a progressive die to create rotor and stator laminations, and illustrate the operations performed at successive stations in the progressive die to create the laminations.

Referring to FIG. 4A, at station W1, a plurality of rotor slots 5, vent slots 7, pilot holes 10 and relief holes 10*a* are punched into that portion of the material that will eventually form the rotor lamination RL. At station W2, the shaded areas designated 11 are punched from the strip. At station W3, 4 tabs 9 are formed. The tabs 9 are used to interlock the rotor laminations for rotor construction, and do not form a part of the present invention.

Figure 4B:
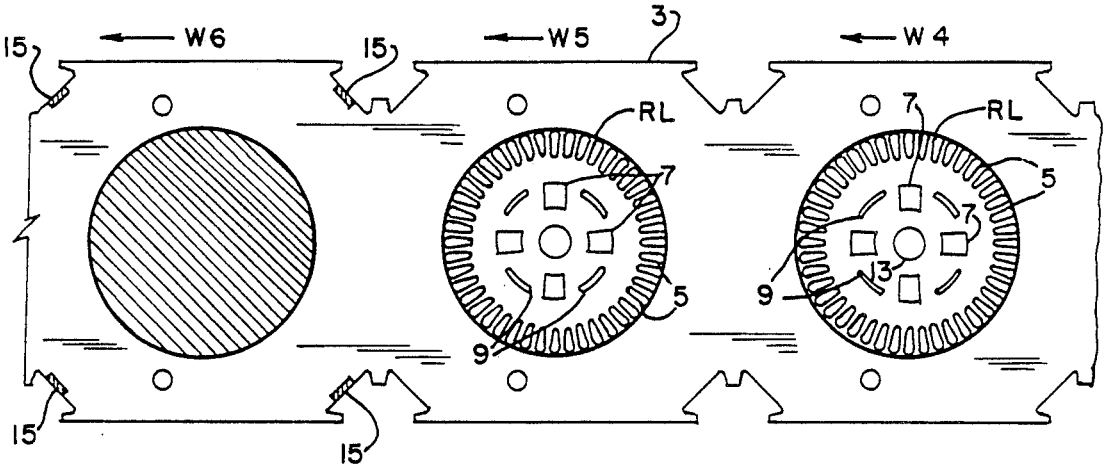

In FIG. 4B, the rotor lamination is punched out of the strip against a spring loaded pad in the stationary part of the die and simultaneously the central opening 13 is punched through the blanked rotor lamination by a stationary punch located in the spring loaded pad. The material in the central opening is punched into the movable part of the die. This part of the die is commonly referred to as the punch holder. The spring loaded pad pushes the rotor blank back into its former position in the strip 3. As can be seen, conventionally the rotor lamination is carried by the strip to an additional station or stations. By rejoining the lamination to the strip in this manner, the lamination moves with the strip to the next station W5 where it is completely removed from the strip. Station W6, is an idle station sometimes used in a lamination die as a shave station when stamping rotor laminations to size.

Figure 4C:
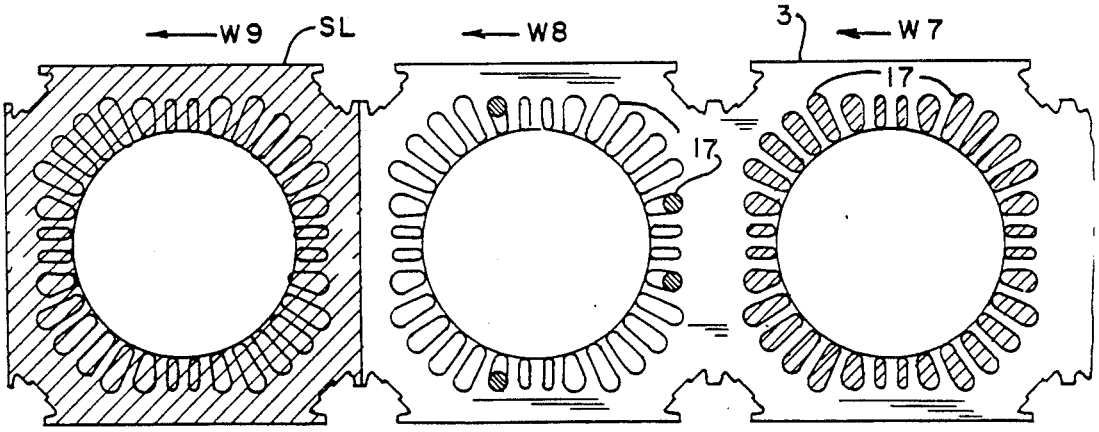

Referring to FIG. 4C, a plurality of stator slots 17, are formed in the strip at station W7. Station W8 is an idle station. At station W9, the stator lamination SL is cut off from the strip as indicated by the shaded area.

As indicated above, the operation performed at station W4, sometimes causes the push back of lamination RL into strip 3 to access improperly, so that the lamination misaligned with the strip. This can occur for various reasons: variations in material thickness or hardness, the operation temperature of the press, or bending of the material of the strip during bush back being a few possibilities. Improper rejoining can cause an overlap between the rotor lamination and the strip or a binding of the material along the circumference of the rotor lamination. As a result, an increased thickness of material is present at the next station which can damage the die or the stamped parts when the die operates on the strip.

Figure 5:
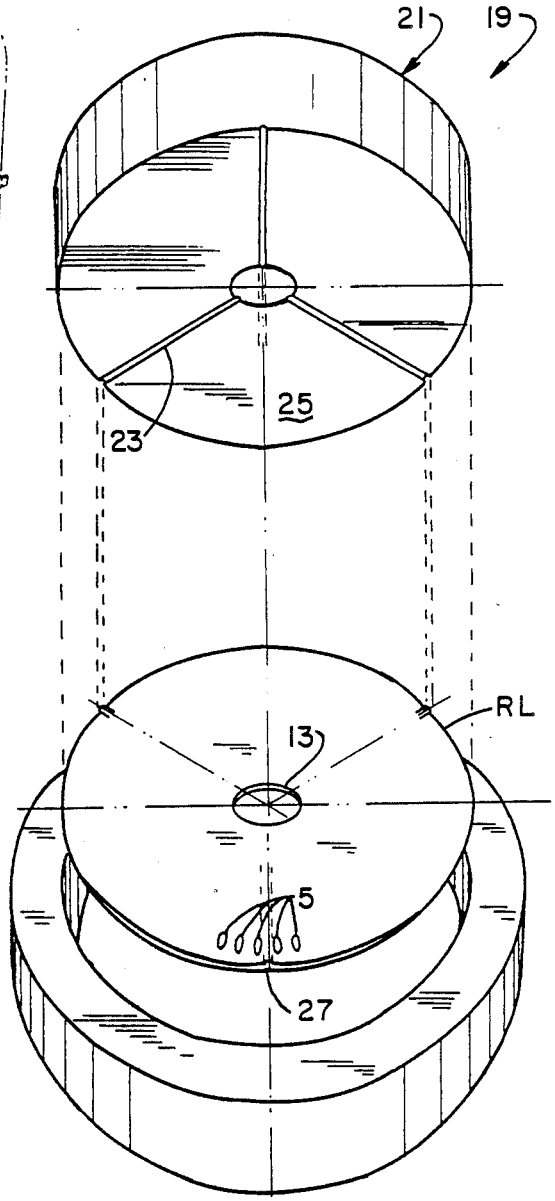
FIG. 5 is a perspective view of a punch and die forming a portion of the progressive die, illustrating the improvement of the present invention.
Figure 6:
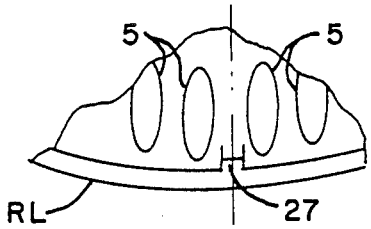
FIG. 6 is a perspective view, partly broken away, of a portion of a rotor lamination illustrating the result of the operation of the punch shown in FIG. 5.
Figure 7:
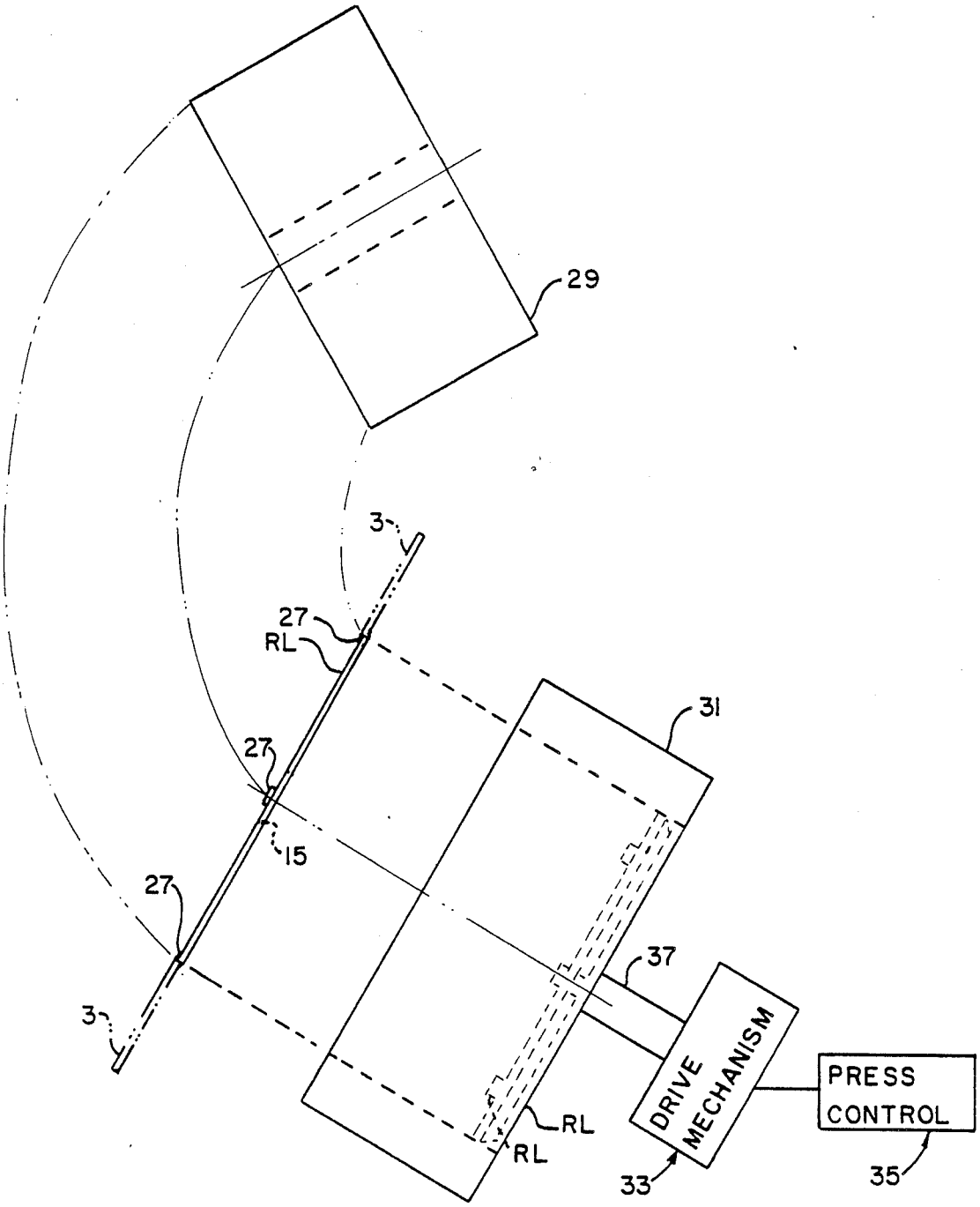
FIG. 7 is a view in side elevation view of a punch used in a succeeding work station to separate the rotor lamination from the material strip from which it is formed; and, FIG. 8 is a side elevational view of a punch press utilizing the improvement of the present invention.

The improvement of the present invention comprises means 19 for substantially, but not completely separating rotor lamination RL from strip 3 at workstation W4. This alleviates the necessity to rejoin the rotor lamination to the strip and prevents the alignment and thickness problems described above. As shown in FIG. 5, means 19 includes a punch 21 forming a part of the progressive die. The punch 21 has at least one groove 23 formed in the bottom, cutting face and edge 25 thereof. Groove 23 is a radial groove, and the preferred embodiment employs three such grooves interrupting the cutting edge 25. The effect of such grooves 23 is that when punch 21 operates on strip 3, a raised, non-severed area 27 is produced on the upper face of the rotor lamination RL (referred to in FIGS. 5 and 6). While the rest of the lamination is severed from the strip, the rotor lamination is still joined to the strip 3 at three points. Thus it is substantially but not completely severed from the strip 3. As best shown in FIG. 6, the grooves 23 preferably are so positioned on the face of the punch as to fall between adjacent slots 5 in the rotor lamination.

When strip 3 has moved to the work station where the rotor lamination is punched out of the strip, a punch 29 knocks out the lamination which falls into a receptacle 31. As is known in the art, it is conventional to provide receptacle 31 with a rotatable design so sequential rotor laminations are rotated with respect to one another. Consequently, the raised areas 27 on the laminations are rotated a predetermined amount, for example 90°, with respect to the previously separated lamination by the operation of the press. In this regard, a drive mechanism 33 is controlled by a punch press control system 35. Mechanism 33 is connected to receptacle 31 by a shaft 37, for example, so to index the receptacle a quarter turn during each cycle of press operation. It will be understood that the drive mechanism and control system can be set to have the receptacle index a greater or lesser amount. As will be appreciated, rotation is done to ensure uniformity in the stack of laminations produced for use in motor 1. Other lamination rotations to effect rotor skew conventionally is accomplished in a later manufacturing step.

It should be apparent to those skilled in the art that many variations of the present invention as disclosed and claimed herein are possible without departing from the coverage of the invention as claimed. Merely, by way of example, the integral carrier tab concept can be employed with any punch press operation, although the invention has been described with particular reference to its use in dynamoelectric machines. The number of grooves 23 and their location with respect to the slots may vary in other embodiments of this invention. As indicated, the number of the grooves employed with the punch form of the integral carrier tabs may vary. Likewise, while I prefer to have the grooves spaced equally about the punch 21, other embodiments may employ other spacing designs. These variations are merely illustrative.

Having thus described the invention, what is claimed and desired to be secured by Letters Patent is:

1. In a punch press for manufacturing stator and rotor laminations for a dynamoelectric machine from a strip of material fed into the press, the press including a die having a series of work stations for forming the respective laminations including one work station at which a punch strikes the strip of material to form a rotor lamination, the rotor lamination having a series of slots formed around the circumference thereof at a prior work station, the improvement comprising a punch having a generally horizontally extending bottom cutting face provided with a plurality of radial grooves spaced about the punch and extending outwardly to an outer cutting edge thereof whereby when the punch strikes the material to form a rotor lamination the material beneath the grooves forms in an upper face of said rotor lamination raised peripherally spaced areas extending to an outer margin of said rotor lamination which are not servered from the remainder of the strip at the outer margin thereof so as to maintain the rotor lamination attached to the strip, the radial grooves being so spaced about the punch that the raised peripherally spaced areas lie between adjacent slots of said rotor lamination; punch means at a succeeding work station for punching out the rotor lamination from the strip of material; enclosed receptacle means with an open upper end at said succeeding work station for collecting the rotor lamination in stacked relationship within said enclosed receptacle means; and means for at least partially rotating the enclosed receptacle means between each operation of the punch means so as to re-position the raised peripherally spaced areas of adjacent stacked rotor laminations in non-aligned relationship to one another and produce a stack of rotor laminations having a uniform thickness in said enclosed receptacle means.

2. The improvement of claim 1 wherein the grooves are equidistantly spaced about the punch.

* * * * *